US007165759B2

(12) United States Patent
Welsh

(10) Patent No.: US 7,165,759 B2
(45) Date of Patent: Jan. 23, 2007

(54) CROWN BLOCK DEAD LINE ANCHOR

(76) Inventor: Walter Thomas Welsh, 510 Farmington Dr., Lafayette, LA (US) 70510

( * ) Notice: Subject to any disclaimer, the term of this patent is extended or adjusted under 35 U.S.C. 154(b) by 137 days.

(21) Appl. No.: 11/097,795

(22) Filed: Apr. 2, 2005

(65) Prior Publication Data

US 2006/0231813 A1 Oct. 19, 2006

(51) Int. Cl.
*B66D 3/08* (2006.01)

(52) U.S. Cl. ..... 254/399; 254/286

(58) Field of Classification Search ..... 254/393, 254/395, 397, 398, 399, 286
See application file for complete search history.

(56) References Cited

U.S. PATENT DOCUMENTS 4,105,189 A * 8/1978 Beall ..... 254/391
4,423,994 A * 1/1984 Schefers et al. ..... 414/22.68
4,434,971 A * 3/1984 Cordrey ..... 254/273
4,787,244 A * 11/1988 Mikolajczyk ..... 73/152.01
4,796,863 A * 1/1989 Reed ..... 254/337
4,836,300 A * 6/1989 Reed ..... 175/57
4,903,443 A * 2/1990 Reed ..... 52/120

* cited by examiner

*Primary Examiner*—Emmanuel M Marcelo
(74) *Attorney, Agent, or Firm*—John D. Jeter

(57) ABSTRACT

The line system on a drilling rig is arranged to place the dead line clamp at the upper end of the derrick. A dead line anchor sheave is preferably located to accept wraps of the dead line to insure reduced load on the dead line clamp. The anchor sheave is preferably lockable to prevent rotation and releasable to rotate the anchor sheave for line feeding from a reserve line reel for maintenance operation. A load sensor is optionally provided to sense dead line load for sensing associated hook loads on the traveling block. An motor is provided, as an option, to rotate the anchor sheave for line feeding maintenance operations.

17 Claims, 4 Drawing Sheets

PRIOR ART

CROWN BLOCK DEAD LINE ANCHOR

This invention relates to drilling rigs and the management of the wire line cables used in the major drill string lifting system. More particularly it relates to the management of the dead line loads that stress the derrick of a drilling rig.

BACKGROUND

Most drilling rigs have derricks with crown blocks generally centered over a vertical line extending upward from the well bore. A traveling block is suspended below the crown block and moves along the vertical line to lift an lower hook loads, which often include a drill string suspended in the well. Both the crown block and the traveling block have several sheaves situated side-by-side to turn about a common axis.

A draw works has a powered reel of cable, usually called a line, that extends up to the crown block and is reeved about the crown block and traveling block sheaves to develop the load carrying total capacity needed, and the line finally extends from the crown block to the rig floor where it is secured, usually by a few wraps around an anchor sheave. A line clamp is usually situated between the anchor sheave and the reserve line reel. Due to the coefficient of friction, the friction of the multiple wraps around the dead line anchor may leave little or no load on the line clamp.

The line from the draw works is called a fast line and the line to the clamp is called a dead line. The load on each of the reeved lines is the hook load plus the tare loads related to the traveling block, divided by the number of lines extending upward from the traveling block. For practical estimates, the load on the live line and the dead line is equal to the load on each length of reeved lines. The crown block is loaded by two more lines, the fast line and the dead line, than the number of lines extending from the traveling block.

Operationally, the dead line serves a maintenance purpose. The lines wear more in some locations, along the length, than in other locations. To get the maximum service from the investment in lines, the lines are periodically drawn from an ever-present reserve line spool through the dead line clamp, along the sheave system and onto the draw works spool. To accommodate the added line, some line is cut from the end anchored on the draw works spool. That action puts the more worn line lengths in locations less subject to wear, and the line system deteriorates over the length more evenly. To add safety and convenience to the dead line clamp arrangement, a dead line anchor sheave is usually placed between the clamp and the length of dead line extending to the crown block. The anchor sheave is usually locked, even if it has release means to allow it to rotate during the above described maintenance line feeding operation. Further, the dead line usually activates a hook load indicator. There is considerable resistance to design changes related to the long term successful use of the above described dead line anchoring system.

The derrick is designed and certified for a specific vertical load on the crown block. When being designed, or redesigned, a derrick can qualify for more hook load if there is no dead line to be considered as part of the crown lock load. To aid in the problem description it is convenient to consider a six sheave traveling block. Seven sheaves are needed in the crown block sheave cluster. The sheave carrying the dead line (the seventh sheave) does not rotate during movement of the traveling block. The seventh sheave does rotate during the maintenance activity, to feed line through the system from the reserve line spool. If the seventh sheave is changed to accept more wraps of line (usually 3 to 5), then locked to prevent rotation when normal activity, such as drilling, takes place there is little if any load on the dead line. The crown block load is thus reduced by about one part in fourteen. That load reduction can be in the nature of seventy thousand pounds. A specific derrick can then qualify for a hook load increase of that amount.

To make such changes in the dead line anchor system, safety, hook load indication, and the maintenance line feed has to be considered. This invention addresses those problems.

These and other objects, advantages, and features of this invention will be apparent to those skilled in the art from a consideration of this specification, including the attached claims and appended drawings.

SUMMARY OF THE DISCLOSURE

The dead line anchor system is moved to the top of the derrick. Different derrick top designs have to be considered. In some cases the crown block can be altered to accept the lockable dead line anchor sheave. When space is available, the lockable dead line anchor sheave can be provided with a release mechanism, and a motor can be provided to rotate the lockable sheave for maintenance convenience, to feed dead line for the maintenance line feed activity. When possible, the torque tending to rotate the anchor sheave can be used to measure hook load. The hook load indication can be transmitted to the drillers position by electric or fluid line systems. Several proven hook load indicator systems are available off the shelf.

When space is not available on the crown block sheave cluster, the anchor sheave can be placed elsewhere near the crown block The separate anchor sheave is situated to better position the downwardly directed dead line to the reserve spool at the base of the derrick. A positive line clamp is usually demanded to guarantee security of the dead line. That clamp can be situated near the anchor sheave or at the derrick base, or at both places.

The anchor sheave can be situated to receive the non-moving line rising from the traveling block to eliminate the need to pass the non-moving line over a sheave in the sheave cluster of the crown block

DETAILED DESCRIPTION OF DRAWINGS

In the formal drawings, features common to such constructions, well established in the art and having no bearing upon points of novelty, are omitted in the interest of clarity of description. The omitted features may include such as weld lines, threaded fasteners, bearings, seals, and the like. The omitted features are well known to those skilled in the related art.

Figure 1:
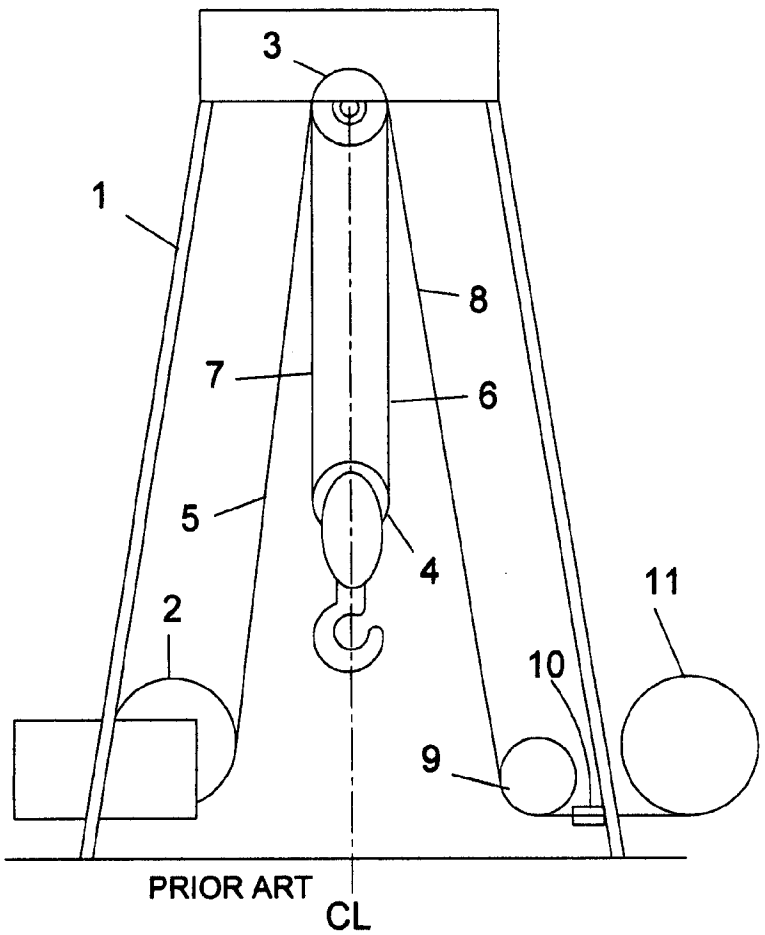
FIG. 1 is a side view of a representative, prior art, drilling rig with a typical cable arrangement.

FIG. 1 shows derrick 1 (prior art) with draw works 2, crown block 3, traveling block 4, fast line 5, reeved lines 6 and 7 (often totaling twelve or more lines), dead line 8, anchor 9, dead line clamp 10 and spare line reel 11, and the extended well bore centerline CL. In drilling activity, dead line 8 does not move. Line reeled by the draw works moves the traveling block 4 vertically.

During maintenance line management, the clamp 10 is loosened, anchor sheave 9 is allowed to rotate and line is fed from the reserve spool through the line system onto the drum of the draw works 2. The anchor end (not shown) of the draw works wound line is cut off to make room for the line to be added to the draw works drum.

Figure 2:
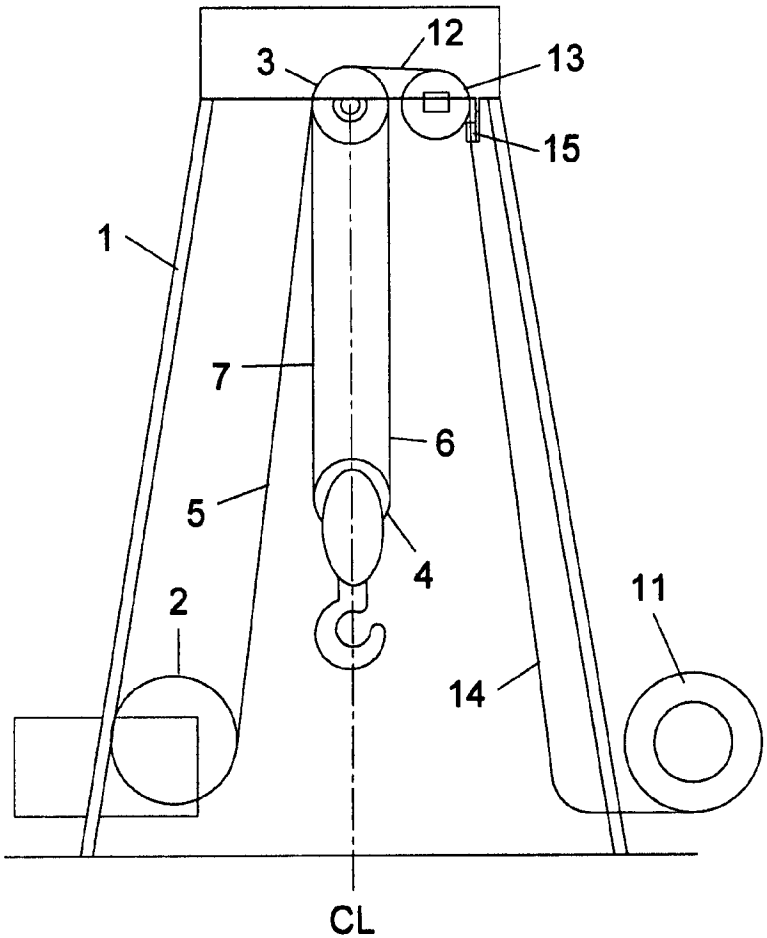
FIG. 2 is the same as FIG. 1, with a novel cable arrangement.

FIG. 2 shows a drilling rig arrangement similar to that of FIG. 1 with the dead line anchored at the derrick top. The anchor sheave 13 is shown separate from the sheave cluster of the crown block 3. The anchor sheave is normally locked during drilling activity, and normally unlocked to rotate during line feed maintenance activity. Line 12, previously the dead line is usually wrapped three to five turns around the anchor sheave 13. In this configuration, with anchor sheave 13 locked, there is little load (or no load) on the dead line clamp 15. Dead line 14 may hang limp to the derrick floor. The spare line reel 11 is usually essential to maintenance activity but may be some distance from the derrick floor. An additional line clamp may be used near the spare line reel to maintain line control.

Figure 3B:
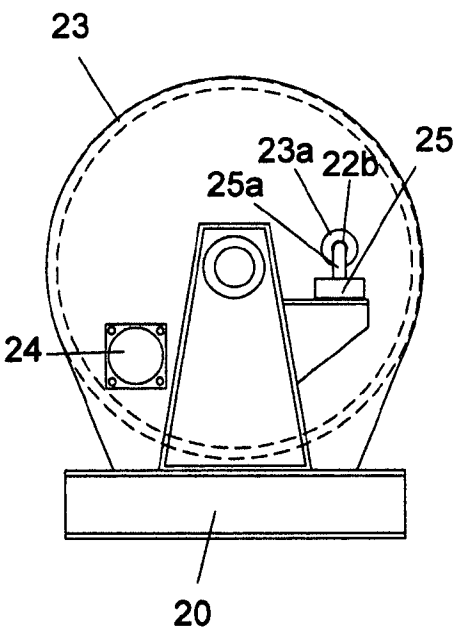
FIG. 3B is an end view of the arrangement of FIG. 3A.
Figure 3A:
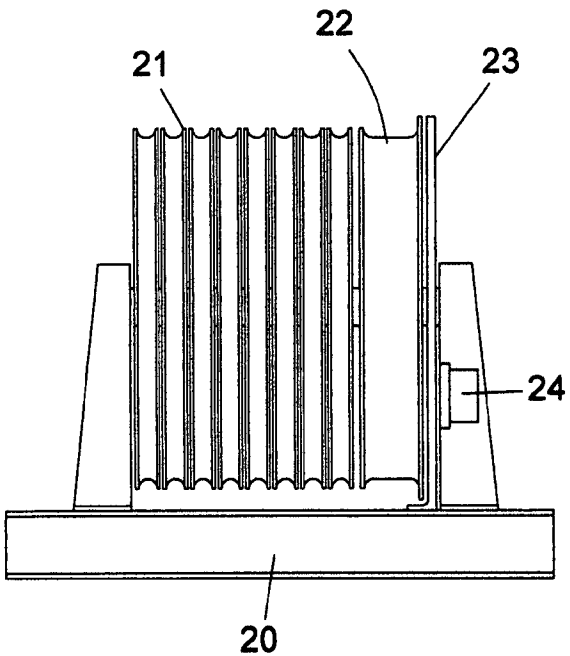
FIG. 3A is a side view of a novel crown block arrangement.

FIGS. 3A and 3B show crown block support 20 which rests atop the derrick structure (not shown) and has anchor sheave 22 added to the sheave cluster 21, on the same axis. Control plate 23 is secured to the base 20. Motor 24 is used to rotate the anchor sheave 22 during maintenance line feed activity. Load sensor 25 is secured to base 20, has removable engagement member 25*a* extending through hole 23*a* in the control plate 23 to removably engage the hole 22*b* in the anchor sheave 22. The load sensor has the effect of locking the anchor sheave and measuring the torque tending to rotate the anchor sheave 22. This sensor measures hook load when calibrated and the output is transmitted to the derrick floor by means not shown. The motor 24 has a pinion (not shown) to engage a ring gear (not shown) on anchor sheave 22. To prevent possible influence upon the hook load sensing function, the motor may be disengaged from the ring gear.

Figure 4:
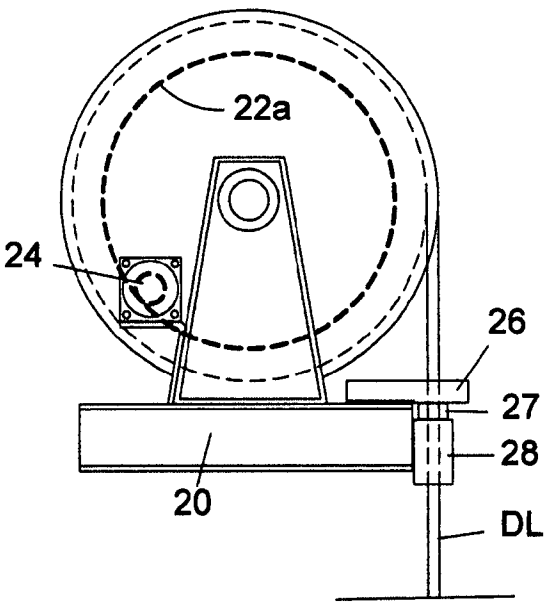
FIG. 4 is an end view of a simpler version of FIG. 3B.

FIG. 4 shows an alternate form of the apparatus of FIGS. 3A and 3B. There is no control plate such as 23. Motor 24 is supported on base 20. Motor 24 is secured directly to base 20 and drives gear 22*a* secured to the anchor sheave 22. Motor 24 is a brake motor and effectively locks when not powered for rotation. Off-the-shelf instruments (not shown) can be used to measure the torque applied to the motor drive shaft. Torque on the motor drive shaft is proportional to hook loads tending to rotate sheave 22.

Means to transmit indications of hook load to the rig floor are not shown but are well known to those skilled in the art. Bracket 26, sensor 27 and dead line clamp 28 are used to alert operators to excessive changes in the load on the dead line DL. Changing loads on line DL would derange the calibration of the torque sensors on the motor drive shaft. Dead line DL descends to the derrick floor and can be directed to a reserve line reel (not shown)

Figure 5:
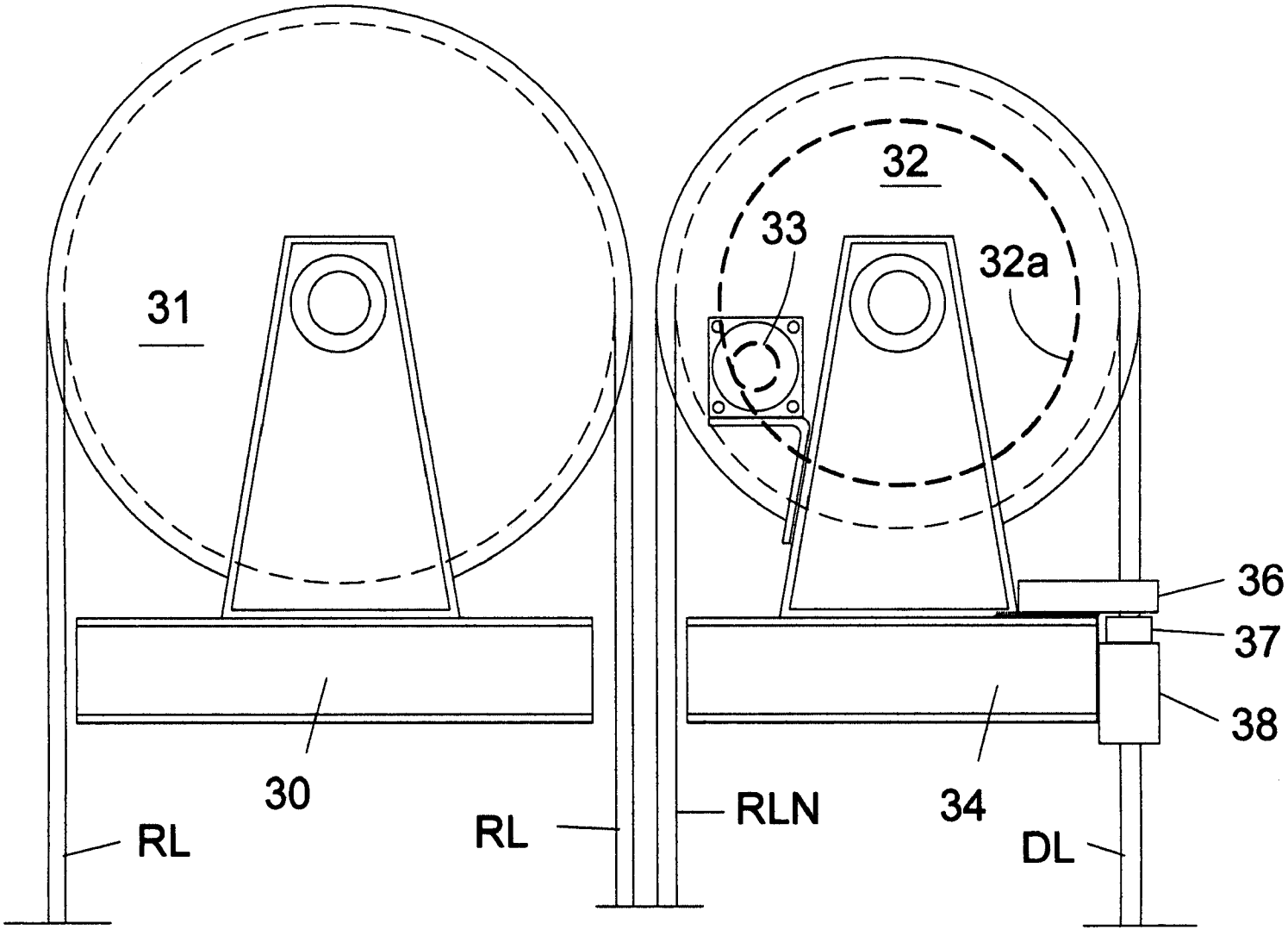
FIG. 5 is an end view of an alternate configuration of the crown block arrangement.

FIG. 5 shows reeved line RLN rising from the traveling block (not shown) and directed to the anchor sheave 32. This arrangement makes more efficient use of the combination of sheaves in the traveling block and the crown block.

Figure 6:
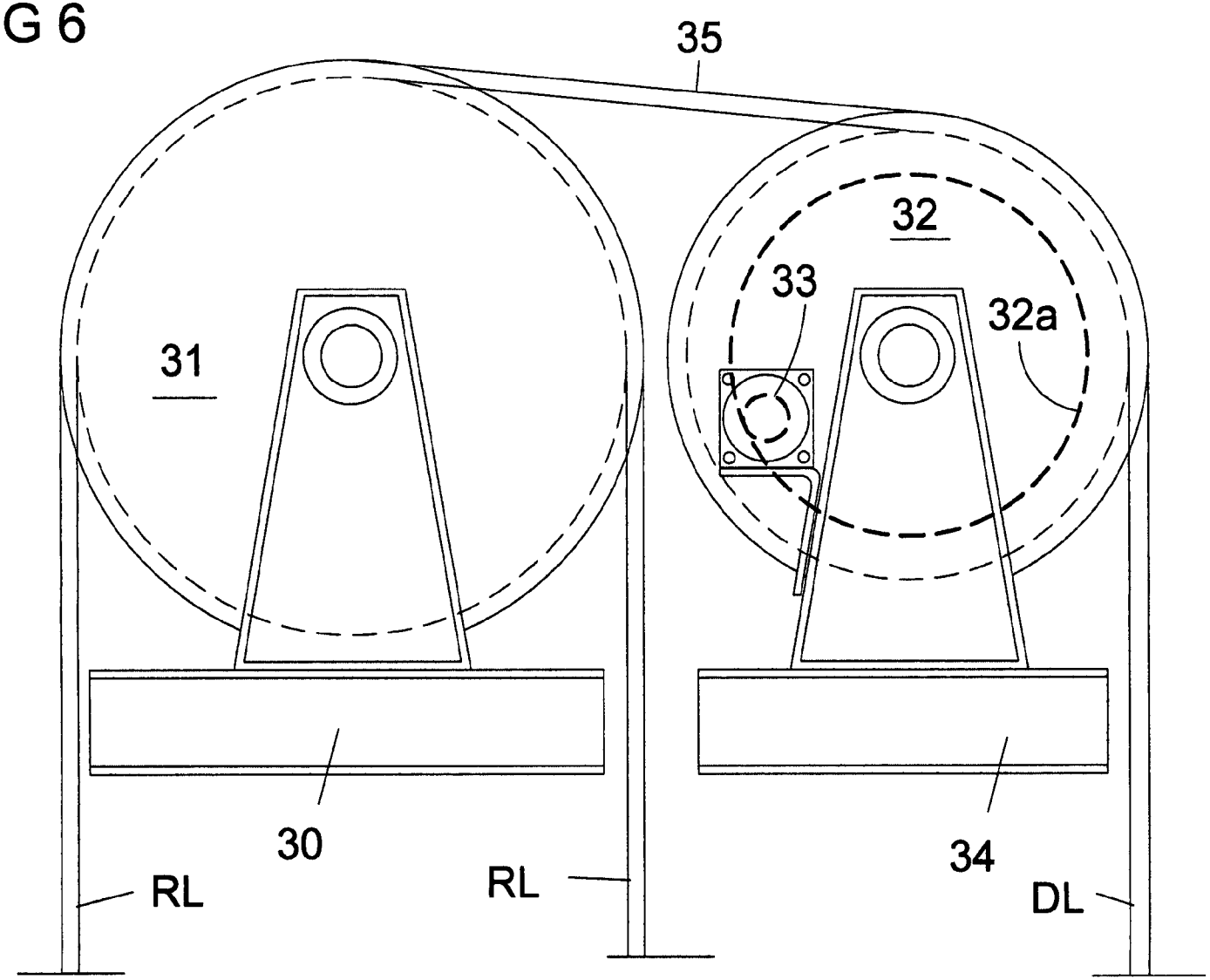
FIG. 6 is similar to FIG. 5 with an alternate line configuration.

FIG. 6 shows an alternate arrangement for support of the anchor sheave 32 near the crown block assembly 30 and 31. The placement of the anchor sheave depends upon the nature of the structure at the top of the derrick to be fitted. Base 30 and sheave cluster 31 need no modification. Base 34 usually rests on the same structure supporting base 30, but may be elsewhere. Line 35 is used to direct reeved line RL to anchor sheave 32. There are usually three to five wraps of line 35 around the anchor sheave. Motor 33 is provided to aid in feeding line during maintenance procedures. Motor 33 can also function as a hook load sensor shown by FIG. 4.

From the foregoing, it will be seen that this invention is one well adapted to attain all of the ends and objects hereinabove set forth, together with other advantages which are obvious and which are inherent to the apparatus.

It will be understood that certain features and sub-combinations are of utility and may be employed without reference to other features and sub-combinations. This is contemplated by and is within the scope of the claims.

As many possible embodiments may be made of the features of this invention without departing from the scope thereof, it is to be understood that all matter herein set forth or shown in the accompanying drawings is to be interpreted as illustrative and not in a limiting sense.

I claim:

1. A dead line load reducing apparatus comprising:

a) a drilling rig derrick with a crown block, traveling block, draw works, and a line system extending from a reserve reel, through a dead line clamp to the crown block, reeved about the sheaves of sheave cluster of the crown block and traveling block and from the crown block to a line drum on the draw works;

b) an anchor sheave on the crown block, on an axle carrying the crown sheave cluster, to accept at least two turns of the dead line; and c) a dead line clamp on structure supporting the crown block situated to receive the line extending from the anchor sheave to the reserve reel.

2. The apparatus according to claim 1 wherein a releasable rotation lock is situated to selectively prevent rotation of the anchor sheave.

3. The apparatus according to claim 2 wherein a motor is situated to power the rotation of the anchor sheave when the anchor sheave is unlocked.

4. The apparatus according to claim 1 wherein a torque sensor is situated to sense the torque tending to rotate the anchor sheave to indicate the associated load being supported by the traveling block.

5. The apparatus according to claim 1 wherein a load sensor is situated to detect and indicate the force on the dead line to indicate associated load being supported by the traveling block.

6. A dead line load reducing apparatus comprising:

a) a drilling rig derrick with a crown block, traveling block, draw works, and a line system extending from a reserve line reel, through a dead line clamp to the crown block, reeved about the sheaves of the crown block and traveling block and from the crown block to a line drum on the draw works;

b) an anchor sheave situated near the crown block, to accept at least two turns of the dead line; and c) a dead line clamp, on structure supporting the crown block, situated to receive the line extending from the anchor sheave to the reserve reel.

7. The apparatus according to claim 6 wherein a releasable rotation lock is situated to selectively prevent rotation of the anchor sheave.

8. The apparatus according to claim 7 wherein a motor is situated to power the rotation of the anchor sheave when the anchor sheave is unlocked.

9. The apparatus according to claim 6 wherein a torque sensor is situated to sense the torque tending to rotate the anchor sheave to indicate the associated load being supported by the traveling block.

10. The apparatus according to claim 6 wherein a load sensor is situated to detect and indicate the force on the dead line clamp to indicate associated load being supported by the traveling block.

11. The apparatus according to claim 6 wherein said anchor sheave is situated to receive a line rising form the traveling block.

12. A dead line load reducing apparatus comprising:

a) a drilling rig derrick with a crown block, traveling block, draw works, and a line system extending from a reserve reel, through a dead line clamp to the crown block, reeved about the sheaves of sheave cluster of the crown block and traveling block and from the crown block to a line drum on the draw works; and b) an anchor sheave on the crown block to accept at least two wraps of the dead line.

13. The apparatus according to claim 12 wherein a dead line clamp is situated on structure supporting the crown block and situated to receive the line extending from the anchor sheave to the reserve reel.

14. The apparatus according to claim 12 wherein a releasable rotation lock is situated to selectively prevent rotation of the anchor sheave.

15. The apparatus according to claim 14 wherein a motor is situated to power the rotation of the anchor sheave when the anchor sheave is unlocked.

16. The apparatus according to claim 12 wherein a torque sensor is situated to sense the torque tending to rotate the anchor sheave to indicate the associated load being supported by the traveling block.

17. The apparatus according to claim 12 wherein said anchor sheave is situated to receive a line rising form the traveling block.

* * * * *